US009572474B2

(12) United States Patent
Ladisa et al.

(10) Patent No.: US 9,572,474 B2
(45) Date of Patent: Feb. 21, 2017

(54) METHOD FOR CONTROLLING FILLING WITH WATER OF A WATER-CONDUCTING ELECTRIC HOUSEHOLD APPLIANCE

(71) Applicant: Indesit Company S.p.A., Fabriano (IT)

(72) Inventors: Nicola Ladisa, Fabriano (IT); Marco Whilhelmus Gerhardus Ten Bok, Fabriano (IT); Gianluca Benedetto, Fabriano (IT); Giacomo Marvardi, Fabriano (IT)

(73) Assignee: Indesit Company S. p. A., Fabriano (IT)

( * ) Notice: Subject to any disclaimer, the term of this patent is extended or adjusted under 35 U.S.C. 154(b) by 0 days.

(21) Appl. No.: 14/761,635

(22) PCT Filed: Jan. 16, 2014

(86) PCT No.: PCT/IB2014/058320
§ 371 (c)(1),
(2) Date: Jul. 17, 2015

(87) PCT Pub. No.: WO2014/111875
PCT Pub. Date: Jul. 24, 2014

(65) Prior Publication Data

US 2016/0022113 A1 Jan. 28, 2016

(30) Foreign Application Priority Data

Jan. 17, 2013 (IT) ..... TO2013A0039

(51) Int. Cl.
*A47L 15/00* (2006.01)
*D06F 39/08* (2006.01)
(Continued)

(52) U.S. Cl.
CPC ..... *A47L 15/0023* (2013.01); *A47L 15/0049* (2013.01); *A47L 15/4214* (2013.01);
(Continued)

(58) Field of Classification Search
CPC ..... A47L 15/0023; A47L 15/0026; A47L 15/0028; A47L 15/0049; A47L 15/4214; D06F 33/02; D06F 39/088; Y10T 137/86389
(Continued)

(56) References Cited

U.S. PATENT DOCUMENTS 5,409,023 A * 4/1995 Santarossa et al. A47L 15/0023 134/56 D
5,439,019 A * 8/1995 Quandt ..... D06F 39/088 137/2
(Continued)

FOREIGN PATENT DOCUMENTS

DE 102011003688 A1 8/2012
EP 2276388 A1 1/2011
WO 2011/128176 A1 10/2011

OTHER PUBLICATIONS

ISR International Patent Application No. PCT/IB2014058320, filed Jan. 16, 2014 mailed date Jun. 20, 2014, Applicant: Indesit Company SPA. International Publication No. WO2014111875A1, publication date: Jul. 24, 2014.
(Continued)

*Primary Examiner* — Kevin Lee

(57) ABSTRACT

A method of controlling the filling with water of a household appliance after treatment including activating a wash pump to a first speed, opening a load valve and starting a time counter, closing the valve and stopping the counter, calculating a flow-rate, opening and closing the valve again based on the calculated flow-rate.

11 Claims, 2 Drawing Sheets

(51) Int. Cl.
*A47L 15/42* (2006.01)
*D06F 33/02* (2006.01)

(52) U.S. Cl.
CPC ..... *D06F 33/02* (2013.01); *D06F 39/088* (2013.01); *A47L 2401/08* (2013.01); *A47L 2401/14* (2013.01); *A47L 2401/20* (2013.01); *A47L 2401/24* (2013.01); *A47L 2501/01* (2013.01); *A47L 2501/26* (2013.01); *A47L 2501/32* (2013.01); *D06F 2202/08* (2013.01); *D06F 2202/12* (2013.01); *D06F 2204/086* (2013.01); *D06F 2220/00* (2013.01); *Y10T 137/86389* (2015.04)

(58) Field of Classification Search
USPC ..... 137/15.01, 624.11
See application file for complete search history.

(56) References Cited

U.S. PATENT DOCUMENTS

2013/0186440 A1* 7/2013 Boyer et al. ..... A47L 15/0023 134/56 D
2015/0305592 A1* 10/2015 Pers et al. ..... A47L 15/0023 134/113

OTHER PUBLICATIONS

International Patent Application No. PCT/IB2014058320, filed Jan. 16, 2014, Applicant: Indesit Company SPA. International Publication No. WO2014111875A1, publication date: Jul. 24, 2014.

* cited by examiner

METHOD FOR CONTROLLING FILLING WITH WATER OF A WATER-CONDUCTING ELECTRIC HOUSEHOLD APPLIANCE

FIELD OF THE DISCLOSURE

The present disclosure refers to water-conducting electrical household appliances in general, such as dishwashing machines and laundry washing machines, and has been developed with particular reference to the methods for filling with water such electrical household appliances.

Water-conducting electrical household appliances such as dishwashers and laundry washing machines have a treatment container, intended to receive items to be washed. In general, a treatment program of one such household electrical appliance comprises a plurality of operating steps, at least some of which are performed with water, such a pre-washing, washing, rinsing and soaking steps. Each of these steps involves filling with water the treatment container, the execution of the respective part of the treatment and then the drain of the used liquid. In some cases, after an initial filling of water into the treatment container, the control system controls the execution of one or more refilling operations, during a same step of the program.

Water is usually taken from a domestic water supply mains and dosage thereof is performed via a filling sensor, usually a pneumatic-type sensor (such as a pressure switch), a volumetric-type sensor (such as a flow meter with an impeller) or an optical-type sensor (such as a device including a light emitter and a light receiver).

It is possible that, for several reasons, the filling sensor does not function properly and/or does not provide a respective signal to the control system of the machine. EP 2276388 A discloses a method to control the filling of a water-conducting electrical household appliance, according to which the possible condition of total failure of the filling sensor is detected using a washing pump and evaluating the flow-rate characteristic curve of the pump.

PURPOSE AND SUMMARY OF THE DISCLOSURE

The present disclosure aims to provide a method to control the filling with water of a water-conducting electrical household appliance that leave out of consideration the presence of a sensor prearranged for detecting the conveyance of water to the treatment container, i.e., in an appliance which is free of one such sensor.

An auxiliary aim of the present disclosure is to provide a method that, even in the case of electrical household appliances provided with a sensor for detecting water conveyance to the treatment container, enables to obtain the water filling even if, for any reasons, this sensor does not generate any signal or generates abnormal signals.

One or more of these aims is achieved, according to the present disclosure, by a method for controlling filling with water of a water-conducting electrical household appliance having the features indicated in the appended claims. The claims form an integral part of the technical teaching provided herein in relation to the disclosure.

BRIEF DESCRIPTION OF THE DRAWINGS

Further aim, features and advantages of the present disclosure will become apparent from the following description, made with reference to the appended drawings, provided for purely illustrative and not limiting purposes, in which.

DESCRIPTION OF PREFERRED EMBODIMENTS OF THE DISCLOSURE

In this description the reference to "one embodiment" is used to indicate that a particular configuration, structure, or characteristic described in connection with the embodiment is included in at least one embodiment. Thus, the terms "in one embodiment" and the like, present in different parts within this description, are not necessarily all referred to the same embodiment. Furthermore, particular configurations, structures or characteristics may be combined in every suitable way in one or more embodiments. The reference numbers used hereinafter are given for convenience only and not to define the scope of or the embodiments.

It also is pointed that in the following description only the elements useful for the understanding of the disclosure will be described, taking for granted that the electrical household appliance according to the disclosure comprises all the elements known per se for the operation thereof, such as its possible outer cabinet, a user interface, a resistance for water heating, a dispenser of washing agents, and so on.

Figure 1:
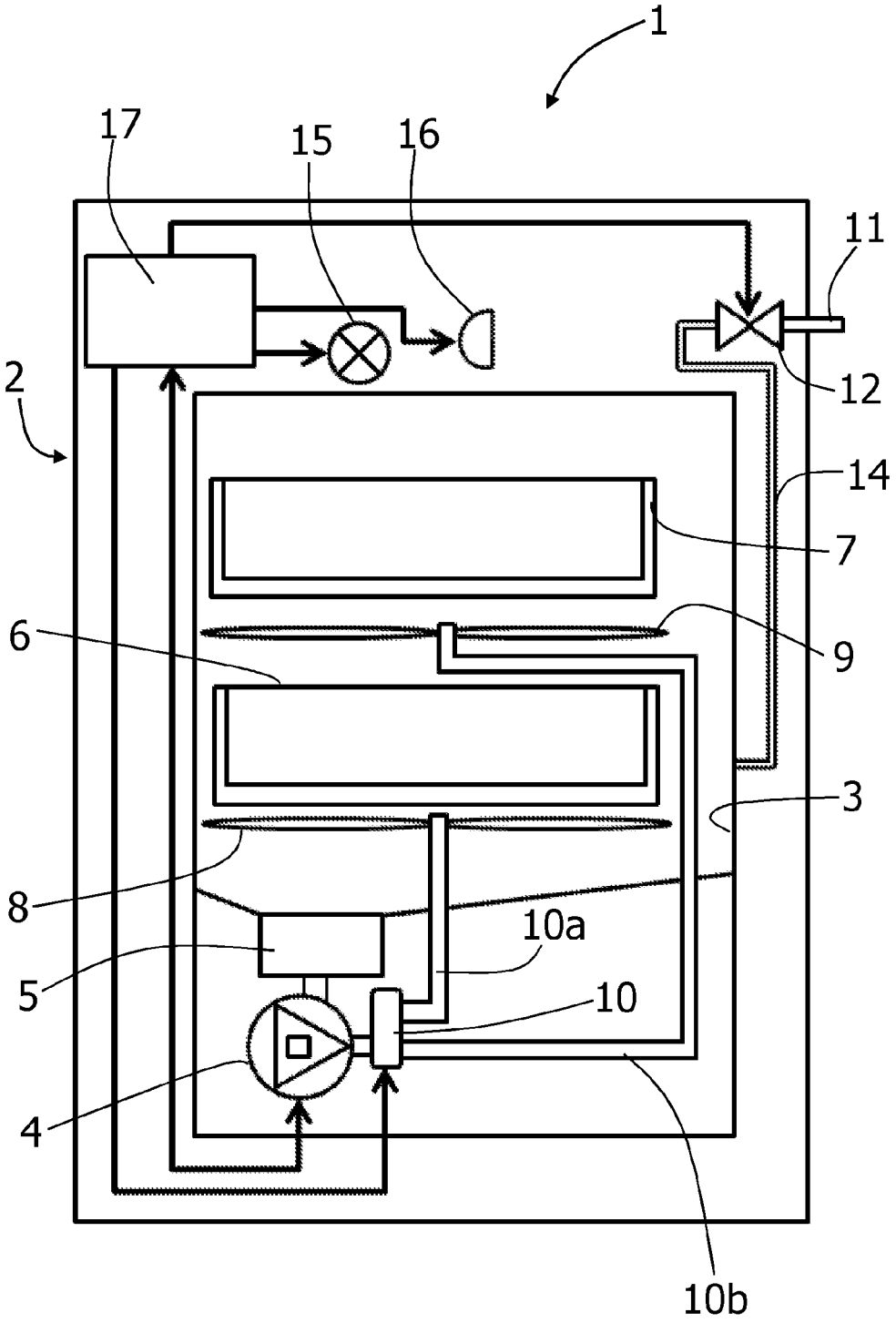
FIG. 1 is a schematic representation in section of a dishwasher implementing the method according to the present disclosure.

In FIG. 1 there is schematically represented a water-conducting electrical household appliance according to a possible embodiment of the present disclosure, here represented by a domestic dishwasher, illustrated in so far as the parts of immediate interest for the understanding of the present disclosure.

The machine 1 has a structure 2 that comprises a treatment container 3, here represented by a wash tub, below which a housing space is defined in which various functional components of the machine 1 are positioned, including a pump 4 and a basin 5 for water collection, as well as other components not shown in the figure for sakes of greater clarity of the drawing. The wash tub 3, of a generally known conception, comprises an upper wall, a lower wall and four side walls one of which—the front wall—is constituted by the inner shell of the door of the machine, not shown here (the so-called "inner door"). At least a crockery basket is provided within the wash tub: in the depicted example, the machine 1 has a lower basket 6 and an upper basket 7, designed to contain respective loads of crockery.

The machine 1 has a sprinkling system, which includes at least a sprinkling member to sprinkle with water the dishes contained in a basket. In the shown case, since the machine has two baskets, the sprinkling system includes two sprinkling members 8 and 9, to sprinkle with water the crockery respectively contained in the baskets 6 and 7. The sprinkling system is fed by means of the wash pump 4 and via a known device 10 for the alternating supply of the sprinklers 8 and 9; the device 10 has at least one inlet, connected to the delivery of the pump 4, and at least two outlets, connected via ducts 10*a* and 10*b* to the sprinklers 8 and 9, respectively.

The machine 1 has a supply duct 11, for connection to a domestic water supply mains, on which is a controllable loading valve 12, for example a solenoid valve, preferably of a normally closed type, downstream of which there extends a duct 14 for feeding water into the tub 3.

Still in the figure, reference 15 designates a visual signalling device, such as a control light or a display, arranged placed on a control panel of the machine. Reference 16 designates an acoustic signalling device, such as a buzzer. Presence of the devices 15 and 16, even if preferable, is not essential for the purposes of implementing the disclosure. Reference 17 designates a control system of the machine, preferably including a microprocessor control unit associated to which are memory means containing program information and data for the execution of a plurality of possible treatment programs that can be executed by the machine 1. The control system 17 also includes means for the selection and the start of the cited programs, not represented. In the embodiment of FIG. 1 the machine 1 does not include specific sensor means for detecting the level or volume of water in the tub, such a pressure switch, a volumetric sensor with an impeller, or an optical-type sensor.

In usual operation a user—after having loaded the crockery in the tub 3 of the machine 1—selects a desired treatment program and causes it to start, for example by pressing a suitable key.

According to the disclosure, after the start of the selected treatment program,

- the control system 17 activates the motor of the pump 4 and drives it to a first speed;
- after elapsing of a first time interval, the control system 17 controls opening of the loading valve 12, monitors a signal characteristic of the operation of the motor of the pump 4 and starts a time counter;
- when the signal characteristic of the operation of the motor of the pump 4 reaches a first predefined value, the control system 17 controls closing of the valve 12 and stops the aforesaid time counter;
- the control system 17 then calculates a flow-rate value, in function of the value reached by the time counter and calculates, in function of the calculated flow-rate value, a second time interval of opening of valve 12, required to obtain a predetermined volume or level of filling with water of the tub 3;
- the control system 17 then controls a new opening of the loading valve 12, and
- upon elapsing of the second time interval, the control system 17 controls closing of the loading valve 12.

The aforesaid characteristic signal can be for example the amount of current absorbed by the motor of the pump 4, which is representative of its characteristic curve, and thus of the load thereof. Of course, nothing prevents from monitoring other controllable quantities of the motor, representative of the characteristic curve or of the load of the pump. In one embodiment, the motor of the pump 4 is an electrically controlled brushless motor or a permanent magnet motor controllable in speed.

It will be appreciated that, being known the characteristics of the hydraulic circuit of the machine 1, via experimental tests it is possible to determine, —for various speeds of the motor of the pump 4 and for respective values of current absorptions—corresponding volumes or ranges of volumes or levels of water in the tub. This information is encoded in appropriate way in the memory means of the control system 17 and usable for the purposes of the implementation of the process described herein.

It should also be recalled that the domestic water supply networks are at a substantially constant flow rate. Moreover, the loading electro-valves of water conducting electrical household appliances—for example the valve 12—often include a flow or pressure regulator, also having the function to stabilize the water flow in transit (see for example EP 1456576 A).

The activation of the motor of the pump 4, even before water is actually conveyed into the tub, has essentially the function to provide the control system with a reference value or an "experimental zero" value: in this phase, preferably, the control system monitors in any case the aforesaid characteristic signal. Monitoring of the characteristic signal in this initial phase may be also used by the control system 17 to detect the possible presence in the tub of a significant residual volume of water, for example in order to temporarily start a drain pump and/or activate a signalling of such anomalous condition, for example via the device 15 and/or the device 16.

The aforesaid first time interval, during which the pump 4 is kept active in the absence of water in the treatment container (for example at a speed between 1200 and 2500 rpm), is relatively short, preferably comprised between 10 and 30 seconds, very preferably between 15 and 20 seconds. After the expiry of this time interval, the system 17 makes the valve 12 to open, starts a time counter substantially in concomitance with the opening of the valve 12 and monitors the absorption of the motor of the pump 4 (or other characteristic signal). In this step, therefore, water is conveyed in the tub 3, via the ducts 11 and 14, at a flow-rate which is substantially normally constant.

When the absorption value (or other characteristic signal) reaches a first predefined value, the control system 17 controls the closing of the valve 12 and stops the aforementioned time counter.

As previously mentioned, through experimental tests it is possible to determine, for various speeds of the motor of the pump 4 and for corresponding values of current absorption, the corresponding volumes or ranges of volume or levels of water in the tub. On this basis, when the absorption of the motor of the pump (or other characteristic signal) assumes a certain value indicative of a given volume of water in the tub—for example two liters—the conveyance of water can be interrupted. Based on this estimated volume of water and by knowing the time required to convey this volume of water in the tub (i.e., the value reached by the time counter), the control system is easily able to calculate a corresponding flow-rate value. Consequently, based on this calculated flow-rate value, the control system is also able to easily calculate the time for which the valve 12 will have be again kept open to reach the predetermined amount of water considered necessary to perform an efficient treatment (for example, 4.5 liters).

The above described procedure—including the calculation of the flow-rate value—is performed by the control system on occasion of the first water filling that occurs in the first moments of each step of treatment with water provided by the treatment program under execution. Moreover, according to a possible variant, the flow-rate value calculated during the first treatment step provided by a program can also be used for the purposes of dosing the water required for the execution of the subsequent steps, i.e. without requiring a new recalculation each time. The treatment step in question can be, in case of a washing machine, a prewash step, a washing step, a rinsing step, a soaking step.

As mentioned in the introductory part of the present description, in some cases, during a same step of a treatment program, there can also be carried out water refilling operations, after the initial water filling. In this perspective, if a treatment steps provided by the program provides for a refilling of water after the first water filling, the flow-rate value calculated by the control system 17 is used to calculate a third time interval of opening of the valve 12, necessary to obtain a predetermined volume of water refilling in the tub 3. Clearly, in this case, the system 17 will control a new opening of the valve 12 and closing thereof when the aforesaid third time interval is elapsed.

As previously seen, in the specific case of a dishwasher 1 the sprinkling system of which includes at least two sprinkling members 8 and 9, a device 10 is usually provided for the alternating supply of the same sprinklers, i.e. a device that enables to selectively supply only the lower sprinkling member 8, or both sprinkling members 8-9, and possibly only upper sprinkling member 9. The hydraulic characteristics of the spraying system vary significantly depending on the sprinkler or sprinklers which is/are fed, with consequent different loads of the pump, and hence different values of the characteristic signal of the monitored motor. For this reason, preferably, the information usable for the purposes of the implementation of the method described herein, encoded in the memory means of the control system 17, are set according to a predetermined condition of the spraying system, or a specific operational condition of the device 10, among the possible conditions that it may take. For this reason, in a preferred embodiment of the disclosure, before the start of the procedure of calculation of the flow-rate value previously mentioned, the control system 17 verifies the operational condition of the device 10 and, if the device itself is not in a predefined operational condition, the control system 17 controls the switching of the device 10 in such predefined condition. Preferably, the aforesaid predefined condition of the device 10 is the condition of supply of the lower sprinkling member 8 only, that is a condition in which the prevalence of the pump 4 is lower.

In the above described embodiment, the method according to the disclosure is implemented on a water-conducting electrical household appliance—the dishwasher 1—which does not have specific sensor means for detecting the amount of water, loaded in the tub.

According to a variant embodiment, the method of the disclosure is instead implemented in an electrical household appliance having a specific sensor prearranged for detecting conveyance of water to the treatment container. One such case is described hereinafter with reference to FIG. 2, in which the same reference numbers of the previous figures are used, to designate elements technically equivalent to those already described above.

Figure 2:
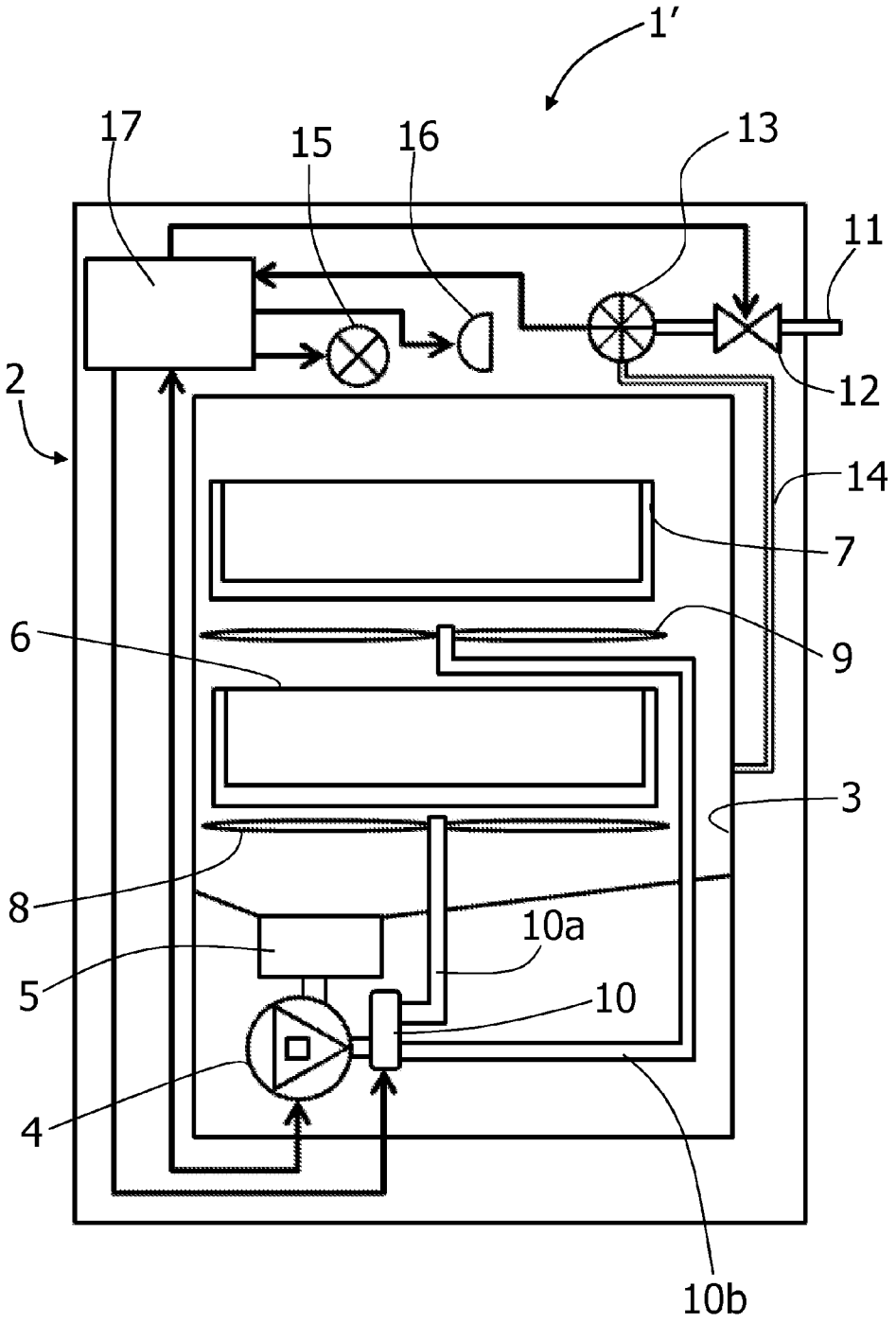
FIG. 2 is a schematic representation in section of a further dishwasher implementing the method according to the present disclosure.

The dishwasher of FIG. 2, here indicated by 1', differs from the one of FIG. 1 for the presence of one said sensor, in the following also defined filling sensor, prearranged for detecting the conveyance of water in the tub 3 from the water supply mains, or to generate signals representative of a level of filled water or the volume thereof. In one embodiment, such as the represented one, the aforesaid sensor device is a volumetric sensor with an impeller, designated by 13. Sensors of this type are well known in the field. Reference can be made, for example, to EP 0599341, for a description of a flow meter of this type, suitable for the purposes of use on the machine 1'.

In general terms, one such sensor includes an impeller which is set in rotation by the fluid, this impeller integrating or having associated one or more excitation elements; a stationary part of the sensor then includes a detector, suitable to be excited by the excitation elements movable with the impeller. The excitation element or elements can be magnetic-type, in which case the detector is a magnetic field detector; as an alternative the detection of the rotation of the impeller can be carried out by an optical detector, in which case it is a part of the same impeller that obtain the excitation means.

Very briefly, a fluid that enters the sensor device causes the impeller rotation and its number of revolutions—which is proportional to the entered volume of fluid—is detected by means of the aforementioned detector. In the example, the filling sensor 13 with impeller is operatively set between the duct 11 and a duct 14 for feeding water into the tub 3.

At the start of each of the treatment steps with water provided by the program, the system 17 controls opening of the valve 12, which is kept open as long as the same system does not detect, via the filling sensor 13, the filling in the tub 3 of a determined volume of liquid. In the meantime, or later, the control system 17 controls starting of the washing pump 4, after any possible switching of the device 10, if required. The water loaded in the tub reaches one or both of the sprinkling members 8, 9 and is sprayed on the content of the baskets 6, 7. The water then falls on the bottom of the tub, to flow off into the collecting basin 5, where it is again set into circulation by the pump 4. At the end of the treatment step, the control system controls stopping of the wash pump 4 and starting of a drain pump, not shown. Once draining of the previously used water has ended, the drain pump is stopped and the system 17 controls a new opening of the valve 12, to load the water volume required for the execution of a subsequent treatment step of the program.

As seen, after the selection and the start of a treatment program, during the phase of loading of water from the water supply mains, the control system 17 monitors a return signal from the filling sensor 13 and uses it in order to control closing of the valve 12.

In the variant of the disclosure here proposed, the filling procedure described above, based on the calculation of a flow-rate value, is performed if the control system 17 of the machine 1 detects the absence of signals from the sensor 13 and/or the presence of signals from the sensor 13 that are not usable for the purposes of water dosing.

Regarding the first case, after the start of the treatment program, the control system 17 controls the opening of the valve 12 and monitors the sensor 13: in the absence of a signal from the sensor 13 within a given time interval from the valve opening, for example comprised between 10 and 250 seconds, the system 17 controls the execution of the filling procedure described above, based on the calculation of the flow-rate value. The absence of a signal from the sensor 13 may be due, for example, to a failure of the sensor 13 so relevant that emission of a signal is not enabled, such as a jamming of its impeller or the accidental disconnection of a connector thereof.

It is also possible that the filling sensor 13 generates a signal, but this signal is not interpretable or usable in an effective way by the control system 17 for the purposes of the dosage of the water volume required for the machine operation.

For example, in a common impeller-sensor 13 the number of pulses of the output signal is substantially proportional to the volume of water that passes through the sensor itself. Given that the domestic water supply mains are at substantially constant flow rate, the number of pulses generated by the sensor in a time unit is, on average, comprised in a predetermined range of values, which can be stored in the control system 17. It is however possible that, due to a sensor failure, the number of pulses in the time unit does not fall in the above range: think, for example, to a sensor 13 whose impeller, due to a damage of its pivot pin or of the supports thereof, rotates slowly and jerkily or conversely rotates too quickly, or even to a malfunctioning of the detector of the impeller rotation.

Thus, in one embodiment, in the presence of such "anomalous" signal from the sensor 13—that is, a signal which is not compatible with a stored range of reference values, or anyway non interpretable or effectively usable by the control system 17 to determine the volume of water that is being loaded in the tub—the control system 17 controls execution of the filling procedure described above, based on the calculation of the flow-rate value. Even in such a case, then, after the start of the treatment program, the control system 17 controls the opening of the valve 12, monitors the sensor 13 for a given time interval from such opening—for example between 40 and 80 seconds—and detects whether this signal is usable for the purposes of water dosage: if not, the system 17 controls the execution of the filling procedure based on the calculation of the flow-rate value.

It should be still considered that the absence of signal from the sensor 13 of the machine 1, or the generation of an anomalous signal from the sensor might be due to an anomalous condition of the water supply network, rather than of the sensor 13.

For example, the absence of signal may be due, rather than to a failure of the sensor 13, to the closing condition of a tap of the fitting connection of the machine 1' or else to the total absence of water in the water supply network. On the other hand, a too slow rotation of the impeller of the sensor 13 may be indicative of the fact that the flow rate of water entering the machine 1 from the water supply mains is very low, such as to involve excessively long times for the attainment of the water volume required for the execution of a treatment step.

To cover also such possible contingencies, according to one embodiment of the disclosure, it is provided that, if the signal characteristic of the operation of the motor of the pump 4 does not reach the first predefined value within a given time interval (for example 60 seconds), the control system 17 controls ending of the treatment program, and then set itself in a stand-by state, determining thereby also the closing of the loading valve 12. Preferably, moreover, before controlling ending of the treatment program, the control system 17 drives the activation of a signalling by means of at least one of the devices 15 and 16 and/or generates a fault code, which is in any case visually and or acoustically highlighted on occasion of a later use of the machine 1.

It will be appreciated that the procedural steps just described, designed to cause ending of the program and its possible signalling, can be carried out by the control system 17 both in the case of implementation on a machine 1 without a filling sensor, and in the case of a machine 1' provided with one such a sensor 13.

In the first above mentioned case—of the total absence of a signal from the sensor 13—it is possible to subdivide the above time interval in which the sensor 13 is monitored into two distinct sub-periods of time. In the absence of any signal from the sensor 13 until the end of a first sub-period of time after the opening of the valve 12, the control system 17 drives the activation of a signal from at least one of the visual signalling device 15 and the acoustic signalling device 16. In a preferred embodiment, both signalling are activated. In this way, the user is notified immediately in relation to an abnormal condition of the water mains, such as the closed condition of the tap of the fitting connection of the machine or the absence of water in the water mains.

The said first sub-period preferably has a relatively short predetermined duration, approximately not greater than one minute and is preferably comprised between 10 and 30 seconds, most preferably about 15 seconds. Note that the first loading of water in a treatment program typically happens a few seconds after the start of the program itself and therefore, in accordance with a preferred embodiment of the disclosure, the anomaly warning signal occurs after a relatively short time after the start of the program, when the user is presumably still in the nearby of the machine 1.

In the absence of signal from the filling sensor 13 until the end of a second time sub-period, after the first sub-period, the control system 17 controls the ending of the treatment program. Preferably, in the course of the second sub-period, the control system 17 keeps active the visual signalling and/or the acoustic signalling generated by the device 15 and/or the device 16, as well as, verifies the filling sensor 13.

In a preferred embodiment the second sub-period has a predetermined duration longer than the first sub-period, approximately not longer than five minutes, preferably comprises between 200 and 250 seconds, most preferably about 220 seconds. In this way, after having warned with certainty the user concerning the presence of an anomaly during the loading of the water, a sufficiently long time (preferably at least 2-3 minutes) is offered to the user to perform any corrective actions. In other words, even after the signalling of the malfunction signal has started, the control system 17 remains in a waiting condition for a certain period, continuing to monitor the condition of the filling sensor 13: if during this time—the aforementioned second sub-period—the signal from the sensor 13 occurs, then the treatment program can goes on in the usual way; this may happen, for example, if the tap of the fitting connection of the machine 1, which was initially closed, is opened again by the user after the start of the visual and/or acoustic signalling.

Conversely, in the case of a prolonged absence of the signal from the sensor 13 throughout the whole second sub-period, the program is stopped by the control system 17, which then set itself in a stand-by state. As mentioned, ending of the program involves the closing of the loading valve 12. Preferably, but not necessarily, ending of the program also implies deactivation of the signalling means 15, 16: in an embodiment, however, before making the program to end, the control system 17 generates a fault code that is in any case visually and or acoustically highlighted on occasion of a later use of the machine.

The procedural steps just described above, concerning the total absence of any signals from the sensor and the signalling of this circumstance to the user of the machine, can also be implemented regardless of the above-described methodology based on the calculation of a flow-range value. For such an implementation, that therefore does not require the detection of a signal characteristic of the operation of the motor of the pump 4, after the start of the treatment program, the control system 17:

- controls the opening of valve 12;
- monitors the sensor 13;
- controls the activation of a signalling, in case of absence of signal from the sensor 13 until the end of a first sub-period of time after the opening of the valve 12, and
- controls the ending of the treatment program, in the absence of signal from the sensor 13 also until the end of a second sub-period.

As mentioned, preferably the first sub-period of time is not greater than a minute and is preferably comprised between 10 and 30 seconds, while the second sub-period of time is not greater than five minutes and is preferably comprised between 200 and 250 seconds.

Therefore, after a relatively short time from the opening of the valve 12 (between 210 and 270 seconds after the opening of the valve 12, in the given example), the program is however made to end, if the absence of signal from the sensor 13 persists. As said, the absence of signal from the sensor 13 may possibly be overcome during the second sub-period of time.

In the following there is described a method, being alternative to the one above described and based on the calculation of a flow-rate value, to handle the case of presence of an "anomalous" signal from the sensor 13—that is, a signal not compatible with a stored range of reference values, or anyway not interpretable or not effectively usable by the system 17 to determine the volume of water that is loaded in the tub. In such an alternative method the control system 17 keeps the loading valve 12 open until the elapsing of a first predetermined time interval, for example between 40 and 80 seconds, preferably about 60 seconds.

After elapsing of the first predetermined time interval, the control system 17 controls closing of the loading valve 12 and drives the motor of the washing pump 4 to a first predetermined speed, preferably a speed lower than the normal washing speed, for example between 1200 and 1500 rpm preferably about 1400 rpm. The fact that the sensor 13 generates a signal, even if an anomalous one, should be indicative of the fact that water is still entering the electrical household appliance: the activation of the pump is essentially finalized to verify the actual presence of water in the tub 3.

The system 17 monitors a signal characteristic of the operation of the motor of the pump 4 and evaluates it, by comparing it with a first threshold value. If the characteristic signal does not reach and/or does not exceed the first threshold value, the control system 17 controls a new opening of the valve 12 and then evaluates again the signal characteristic of the operation of the motor of the pump 4: when this characteristic signal reaches or exceeds the first threshold value, the system 17 controls closing of the valve 12.

Similarly to what has been already explained in relation to the method based on the calculation of the flow-rate value, the aforesaid characteristic signal can be the amount of current absorbed by the motor of the pump 4, which is representative of the characteristic curve thereof, and hence of its load, or else other controllable quantities of the motor, representative of the characteristic curve or of the load of the pump.

In one embodiment it is provided that, if after the aforesaid new opening of the valve 12, the absorption of current by the motor of the pump 4 (or other monitored characteristic signal) does not exceed the aforesaid first threshold value within a second predetermined time interval, the control system 17 drives to end the treatment program (and so the closing of the valve 12), after a possible generation of at least one signalling for the user, through the device 15 and/or the device 16, and/or after generating a fault code to be highlighted on occasion of a subsequent use of the machine. Such a circumstance may be deemed indicative of the fact that the flow rate of the water entering the machine 1 from the water supply mains is very low, so to require excessively long times for the achievement of the volume of water necessary for the execution of a treatment step. The aforesaid second predetermined time interval can be for example comprised between 60 and 120 seconds, preferably between 40 and 80 seconds, and very preferably be about 60 seconds.

After the closing of the valve 12 that occurs after the above third time interval, or anyway after the achievement of the aforesaid first threshold value, the control system 17 drives the motor of the pump 4 to a second speed, preferably greater than the first speed, very preferably at the washing speed, indicatively between 2200 rpm and 2700 rpm, preferably about 2500 rpm. Thereafter the control system 17 newly evaluates the absorption (or other characteristic signal) of the motor of the pump 4: if this signal reaches or exceeds a second threshold value, the system 17 controls the prosecution of the treatment program in the usual way. Otherwise, the control system 17 controls a new opening of the valve 12, evaluates again the absorption (or other characteristic signal) and when this signal reaches the second threshold value—being indicative of the achievement of a volume or level of water in the treatment container suitable for the performance of the treatment—the control system 17 controls closing of the valve 12 and controls, in the usual way, the prosecution of the treatment program. It will be appreciated, in fact, that based on the experimental data stored in the control system 17, the latter is capable to recognize which is the value or range of values of current absorption that—at the washing speed of the motor of the pump 4—corresponds to a water level in the tub deemed to be sufficient for the execution of an efficient treatment.

In a variant, if within the aforesaid second predetermined time period, the absorption of current by the motor of the pump 4 (or other monitored characteristic signal) does not exceed the first threshold value, the control system 17—rather than ending the treatment program—controls the execution of a subsequent step of the treatment program, in particular after completion of a drain step.

In other terms, assuming for example that the step of the program in which the sensor 13 has generated the "anomalous" signal is the washing step, after the aforesaid second predetermined time interval the control system 17 controls a phase of activation the drain pump of the machine, in order to discharge any possible water loaded in the tub, and then controls the execution of the next step of the program, such as a cold rinse step. Clearly, such rinsing step implies a new loading of water in the tub: if the sensor 13 generates now a signal usable for the water dosage, the process goes on in the usual way; on the contrary, in the presence of an anomalous signal from the sensor 13 the above described logic will be repeated, with the monitoring of the signal characteristic of the motor of the pump 4. If also in this case the characteristic signal does not reach the first threshold value, the control system 17 will be able to perform a drain step, and then pass to the execution of the next treatment step, such as a hot rinse step, similarly to what exemplified above with reference to the cold rinse step.

In the case in which the sensor 13 generates the anomalous signal on occasion of a treatment step that precedes a possible drying step (typically a hot rinse), and in case of missed attainment of the first threshold value by the signal characteristic of the motor of the pump, the control system 17 will be able to control the corresponding drain step, and then the execution of the drying step, if provided. If instead the program does not include such a drying step, the control system 17 controls ending of the program itself.

From the foregoing description the characteristics of the present disclosure are clear, as well as clear are its advantages. The first methodology described, based on the calculation of a flow-rate value enables to control, even in the absence of specific sensor means, the amount of water loaded in the treatment container of a water-conducting electrical household appliance, such as a dishwasher, a laundry washing machine, a washer-dryer. The same methodology can also be used on machines equipped with a special filling sensor, if this latter does not generate any signals or generate anomalous signals.

The second methodology described enables to manage, in a simple and quick way, the case of an absence of any signal from a filling sensor of the electrical household appliance.

The third methodology described enables to manage in a simple and quick way the case of generation, by a filling sensor of the electrical household appliance, of signals being anomalous compared to usual values.

It is clear that numerous variants are possible for one skilled in the art to the described method without departing from the scope of the disclosure as defined in the appended claims.

The second and the third methodologies described above can be both implemented on one and the same water-conducting electrical household appliance, even independently from the first methodology described above.

The disclosure has been exemplified in relation to a water conducting electrical appliance employing a volumetric meter with an impeller, but the disclosure is also suitable of use also in the case of other types of filling sensors, such as pneumatic-type sensors or optical-type sensors.

It is then known that some machines for washing are equipped with an internal reservoir, designed to enable reuse of at least a part of the washing liquid already used for a treatment: the filling sensor provided according to the disclosure can be a sensor set on a water supply line that extends from one such internal reservoir of the electrical appliance to the treatment container thereof.

The invention claimed is:

1. A method for controlling filling with water of a water-conducting electric household appliance having a control system, wherein, after start of a treatment program of the electric household appliance the following steps are provided:

a) the control system activates a motor of a washing pump and drives the motor to a first speed;

b) after elapsing of a first time interval the control system controls opening of a loading valve set on a line for conveying water to a treatment container of the electric household appliance, monitors a signal characteristic of the operation of the motor of the pump and starts a time counter;

c) when the signal characteristic of the operation of the motor of the pump reaches a first predefined value, the control system controls closing of the loading valve and stops the time counter;

d) the control system calculates a flow-rate value in function of a value assumed by the time counter and calculates, in function of the calculated flow-rate value, a second time interval of opening of the loading valve, required to obtain a predetermined volume or level of filing with water of the treatment container;

e) the control system controls a new opening of the loading valve, and f) upon elapsing of the second time interval, the control system controls closing of the loading valve.

2. The method according to claim 1, wherein, before step a), the control system verifies an operating condition of a device for alternated supply of a plurality of sprinkler members of the electric household appliance and, if the device is not in a predefined operating condition, the control system controls switching of said device in said predefined operating condition.

3. The method according to claim 1, wherein the first time interval is comprised between 10 and 30 seconds.

4. The method according claim 1, wherein, if a treatment step provided for by the treatment program comprises a water refilling after a first water filling operated according to steps a)-f):

g) the calculated flow-rate value is used by the control system for calculating a third time interval of opening of the loading valve, required for obtaining a predetermined volume of water refilling in the treatment container;

h) the control system controls a new opening of the loading valve; and i) upon elapsing of the third time interval, the control system controls closing of the loading valve.

5. The method according to claim 1, wherein steps a)-f) are carried out on occasion of a first water filling which occurs in an initial phase of each step of treatment with water provided by the treatment program, particularly selected from among: a pre-washing step, a washing step, a rinsing step, a soaking step.

6. The method according to claim 1, wherein the electric household appliance has a sensor prearranged for detecting conveyance of water to the treatment container, monitored by the control system, and steps a)-f) are carried out in case of absence of a signal from the sensor and/or in case of presence of a signal from the sensor which is not usable for water dosage.

7. The method according to claim 6, wherein after start of the treatment program the control system controls opening of the loading valve and monitors the sensor and, in the absence of a signal from the sensor within a given time period, the control system controls execution of steps a)-f).

8. The method according to claim 6, wherein after start of the treatment program the control system controls opening of the loading valve, monitors the sensor for a given period of time and evaluates if the signal is usable for water dosage and, if the signal is not usable for water dosage, the control system controls execution of steps a)-f).

9. The method according to claim 1, wherein, following step b), if the signal characteristic of the operation of the motor of the pump does not reach said first predefined value within a given period of time, the control system controls ending of the treatment program.

10. The method according to claim 9, wherein, before controlling ending of the treatment program, the control system controls activation of a signalling and/or generates a fault code.

11. The method of claim 1, wherein a treatment container, a loading valve set on a line for conveying water to the treatment container and a control system are provided.

* * * * *